US009567054B2

(12) United States Patent
Ulgen

(10) Patent No.: US 9,567,054 B2
(45) Date of Patent: Feb. 14, 2017

(54) RUDDER MECHANISM FOR MARINE VESSEL

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 0 days.

(21) Appl. No.: 14/796,511

(22) Filed: Jul. 10, 2015

(65) Prior Publication Data

US 2017/0008605 A1 Jan. 12, 2017

(30) Foreign Application Priority Data

Jun. 12, 2015 (TR) ..... 2015 07241

(51) Int. Cl.
*B63H 25/06* (2006.01)
*B63H 25/38* (2006.01)

(52) U.S. Cl.
CPC ..... *B63H 25/383* (2013.01)

(58) Field of Classification Search
CPC ..... B63H 25/38
See application file for complete search history.

(56) References Cited

U.S. PATENT DOCUMENTS 3,752,105 A 8/1973 Hackett
3,982,494 A 9/1976 Posti
4,548,149 A * 10/1985 Del Roso ..... B63H 25/38 114/162
4,919,630 A * 4/1990 Erdberg ..... B63B 3/40 114/163
4,944,702 A * 7/1990 Cain ..... B63H 20/007 440/51
5,046,441 A 9/1991 Kanazaki
5,167,547 A 12/1992 Kobayashi et al.

* cited by examiner

*Primary Examiner* — Stephen Avila

(74) *Attorney, Agent, or Firm* — Vidas, Arrett & Steinkraus, P.A.

(57) ABSTRACT

A rudder mechanism for a marine vessel comprising of rudder that contains a first water flow surface essentially in planar form and an opposite second water flow surface essentially in planar form; a vertical rudder shaft that the rudder is linked by rotation around an axis that essentially extends perpendicular to the water flow surfaces of said rudder; and a drive mechanism for rotating the rudder around said axis. The rudder mechanism contains a rudder slot comprising the vertical rudder shaft and extending from the top section of the rudder towards the bottom section, wherein the rotatable link of the rudder and the vertical rudder shaft is essentially located close to the bottom of said rudder slot and is essentially linked to the vertical rudder shaft of said drive mechanism in such manner to exert force in the radial direction.

15 Claims, 5 Drawing Sheets

RUDDER MECHANISM FOR MARINE VESSEL

TECHNICAL FIELD

The present invention is an improved version disclosed in U.S. Pat. No. 7,806,068 and relates to a rudder mechanism enhancing the control of rudder in backward movement of the marine vessel such as a motor yacht, a boat and in particular a sailboat, thus improving the maneuvering characteristics of the marine vessel.

BACKGROUND OF INVENTION

Steering devices are provided at the rear side of marine vehicles such as vessels to change the direction of movement both in forward and backward directions while maneuvering, such devices consist mainly of an arm, a shaft, and a rudder.

In a typical shaft-rudder construction, vertical axis of the rudder shaft becomes positioned on the front of the rudder when the marine vehicle moves forward, and since the area on the rudder's front section that is exposed to water load during forward motion is relatively small, the rudder can be easily controlled. In other words, since no rudder area is left on the front of the rudder shaft while moving forward, water cannot exert force on such 'non-present' area, which provides an easy control of steering attempts of the vessel.

The preceding condition, however, is much different as such vessel moves backward. In other words, the vertical axis of the rudder shaft becomes positioned on the rear with respect to the rudder's surface area, exposing the rudder's area to water load when the vessel moves backward, and making difficult to control the rudder and exposing the mechanical components thereof to external forces.

The disadvantages are proposed to be addressed in U.S. Pat. No. 7,806,068 issued to the same inventor. In essence, the rudder device of U.S. Pat. No. 7,806,068 comprises an arrangement attached to the vertical rudder shaft in a way to rotate the rudder around an axis perpendicular to the lateral surfaces thereof at an upper side of the rudder. Rotation of the rudder is achieved by a drive, such as piston extending substantially in vertical direction and connected to the vertical rudder shaft from one end and to the rudder from the other end.

While the rudder mechanism of U.S. Pat. No. 7,806,068 provides an effective solution for the purpose, it may not always exhibit a robust rudder structure under the impact of high water forces due to relatively insubstantial constructional structure with the vertical rudder shaft. This may be particularly important as far as relatively large sized sailboat rudders are concerned. On the other hand, positioning of the drive element of U.S. Pat. No. 7,806,068 in vertical direction requires higher moment forces to rotate the rudder rotation axis since the directing of the moment force comes close to the rudder rotation axis.

DESCRIPTION OF THE INVENTION

An object of the present invention is to efficiently improve the maneuverability of marine vessels in backward movement and to maintain the mechanical connection stability in an effective manner by minimizing loads on the rudder rudder surface arising from water.

The objectives are achieved by a rudder mechanism for a marine vessel comprising a rudder having an upper side, a lower side, a first water flow surface having essentially a planar form and an opposite second water flow surface having essentially a planar form; a vertical rudder shaft rotatably communicating with the rudder about an axis essentially extending perpendicular to the water flow surfaces of the rudder; and a drive mechanism for rotating the rudder around the axis. The rudder mechanism according to the invention comprises a rudder slot extending from the upper side of the rudder towards the bottom side thereof for receiving the vertical rudder shaft, wherein the rotatable communication of the rudder and the vertical rudder shaft is provided substantially close to the bottom side of the rudder slot and the drive mechanism is communicated with the vertical rudder shaft to exert force in the radial direction thereto.

According to one embodiment of the invention, the drive mechanism is placed inside the space formed within the rudder. According to one embodiment of the invention, the vertical rudder shaft is supported in accurately formed supports in the rudder, which are extending substantially horizontally.

BRIEF DESCRIPTION OF THE FIGURES

The present invention should be evaluated with the figures described below to ensure the best understanding of the embodiment and advantages together with the additional elements of the invention.

REFERENCE NUMBERS OF THE PARTS IN THE FIGURES

Figures 1A, 1B:
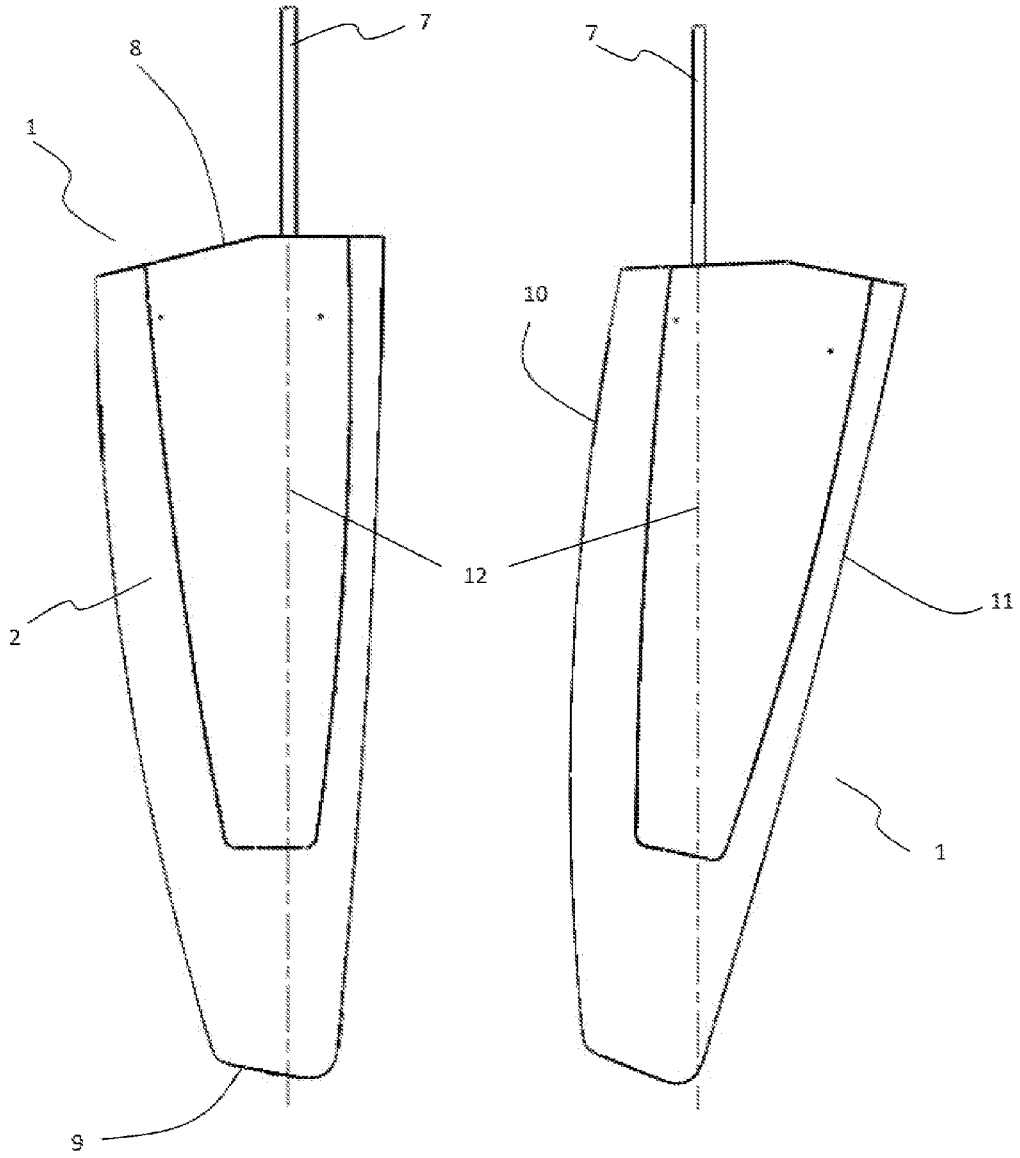
FIG. 1A is a side view showing the rudder position of the rudder mechanism according to the invention during forward movement of the marine vessel.
FIG. 1B is a side view showing the rudder position of the rudder mechanism according to the invention during backward movement of the marine vessel.

1 Rudder
1.1 First rudder part
1.2 Second rudder part
2 First water flow surface
3 Second water flow surface
4 Rudder slot
5 Connection hole
6 Connection pin
7 Vertical rudder shaft
8 Rudder upper part
9 Rudder bottom part
10 Rudder rear edge
11 Rudder front edge
12 Vertical rudder shaft axis
13 First support piece

14 Second support piece
15 Shaft slot
16 Rudder slot bottom
17 Shaft drive motor
18 Motor shaft
19 Hinge
20 Slot inlet opening
22 Motor housing
23 Shaft intake cavity
24 Slide supporting cavity
25 Slide pin
26 Slide
27 Shaft leaning surface
28 Shaft leaning edge

DETAILED DESCRIPTION OF THE INVENTION

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

Throughout the description, the term "marine vessel" should be understood to cover sailboat, motor yacht, boat and all sort of marine vessels.

As illustrated in FIG. 1, the rudder mechanism according to the invention comprises a rudder (1), a vertical rudder shaft (7) extending in a slot (4) of the rudder body and rotatably attached to the rudder (1), and a drive mechanism exerting force to the vertical rudder shaft.

According to a preferred embodiment of the invention, the rudder (1) comprises a first rudder part (1.1) having a shell-like form, and a second rudder part (1.2) having a shell-like form connected to the first rudder part (1.1). The external surface of each rudder part (1.1, 1.2) is formed in such a manner to minimize water resistance. The first rudder part (1.1) is preferably somewhat larger than the second rudder part (1.2) and has slightly different form. That is to say, while the external surface of the first rudder part (1.1) covers one lateral surface of the rudder (1) completely, it covers a certain portion of the other lateral surface.

The surface at one lateral side of the rudder (1) substantially defines a first water flow surface (2) in planar form, and the surface on the other lateral side substantially defines a second water flow surface (3) in planar form.

Figure 4B:
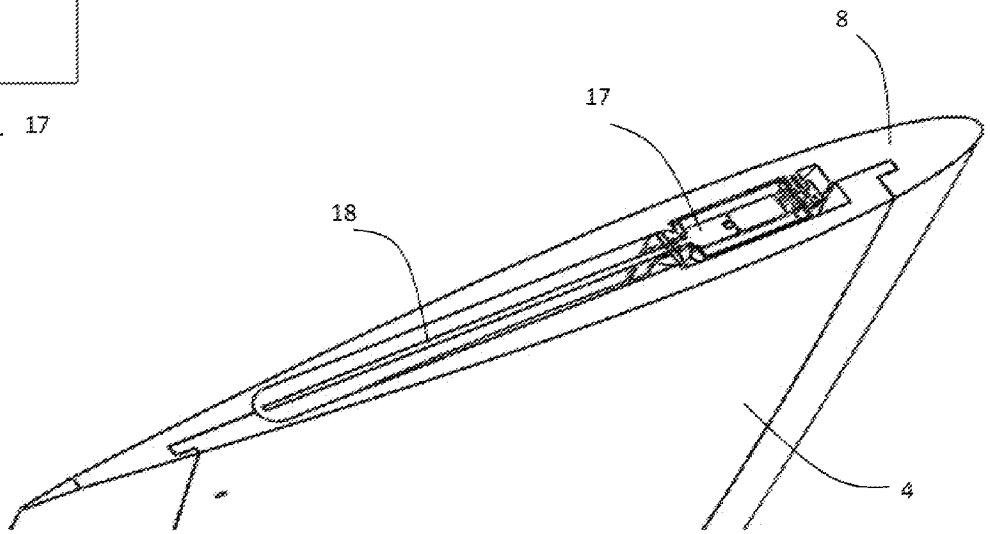
FIG. 4B is the top perspective cross-sectional view of the rudder mechanism.
Figure 4A:
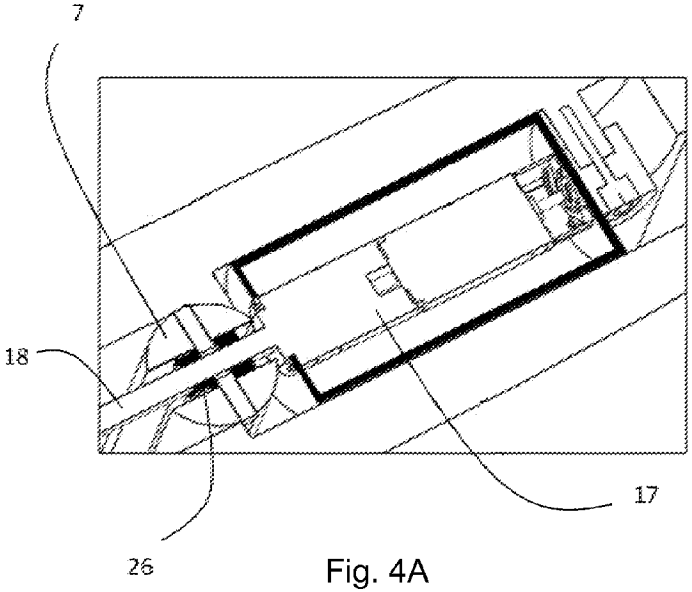
FIG. 4A is a detailed upper perspective cross-sectional view of the motor, motor shaft and slide.
Figures 5A, 5B:
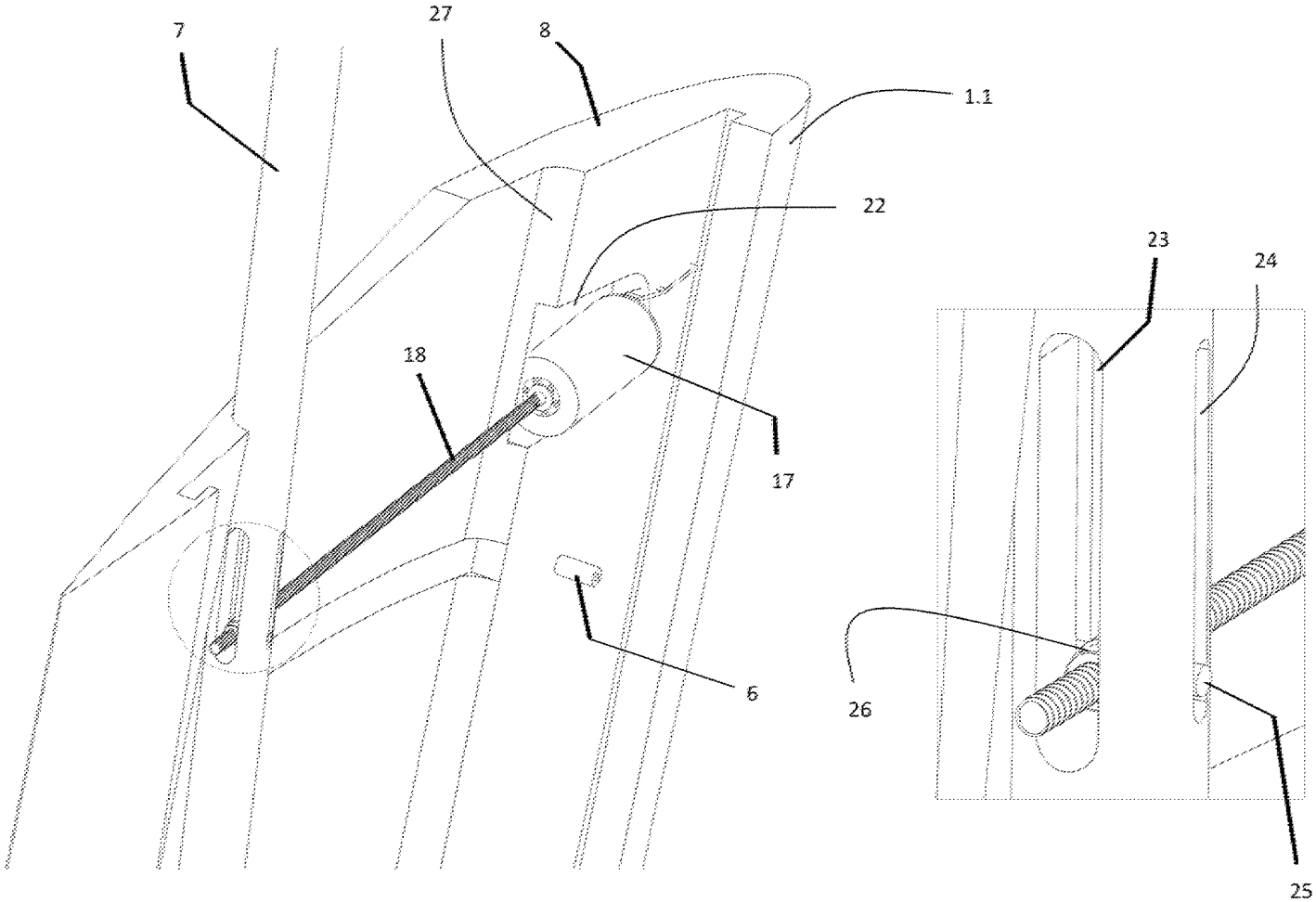
FIG. 5A is a perspective view of the motor, motor shaft and slide in assembly.
FIG. 5B is a perspective detailed view of the motor, motor shaft and slide connected with the vertical rudder shaft.

Therefore, the front edge (11) of the rudder (1) that cuts (splits) the water for reducing water resistance, and the rear edge (10) thereof where the water leaves has an integrated structure with a perfect form. The second rudder part (1.2) comprises a plurality of connection holes (5) formed along the body thickness thereof. As illustrated in FIG. 4A, hollow connection pins (6) protruding from an inner surface of the first rudder part (1.1) corresponding to the connection holes (5) are provided (for the avoidance of visual complexity only one of them is illustrated). After aligning the connection holes (5) and the connection pins (6), the first rudder part (1.1) is then fixed to the second rudder part (1.2) by means of a connection member such as bolts.

The first rudder part (1.1) and the second rudder part (1.2) have outwardly arcuate form and when the first rudder part (1.1) and the second rudder part (1.2) are attached one another, the space between them define a rudder slot (4) in the rudder (1). The rudder slot (4) has a slot inlet opening (20) running from rudder upper part (8) and the rudder slot (4) then terminates at a point that forms the rudder slot bottom (16) at a certain distance in vertical direction of the rudder (1). The rudder slot bottom (16) is preferably positioned at a lower level than the center of the rudder (1) height with respect to the vertical length of the rudder (1). The rudder slot bottom (16) is positioned at a higher level than the rudder bottom part (9).

A vertical rudder shaft (7) coupled to the steering system (not shown in figures) of the marine vessel from the upper end, extends downwards from the slot inlet opening (20) in vertical direction into the rudder slot (4). The bottom end of the vertical rudder shaft (7) is attached to a spot being close to the rudder slot bottom (16), or preferably right at the bottom (16), by means of a rotary hinge (19). The upper part of the vertical rudder shaft (7) extending upwards from the bottom end has a slightly tilted form.

Figures 2A, 2B:
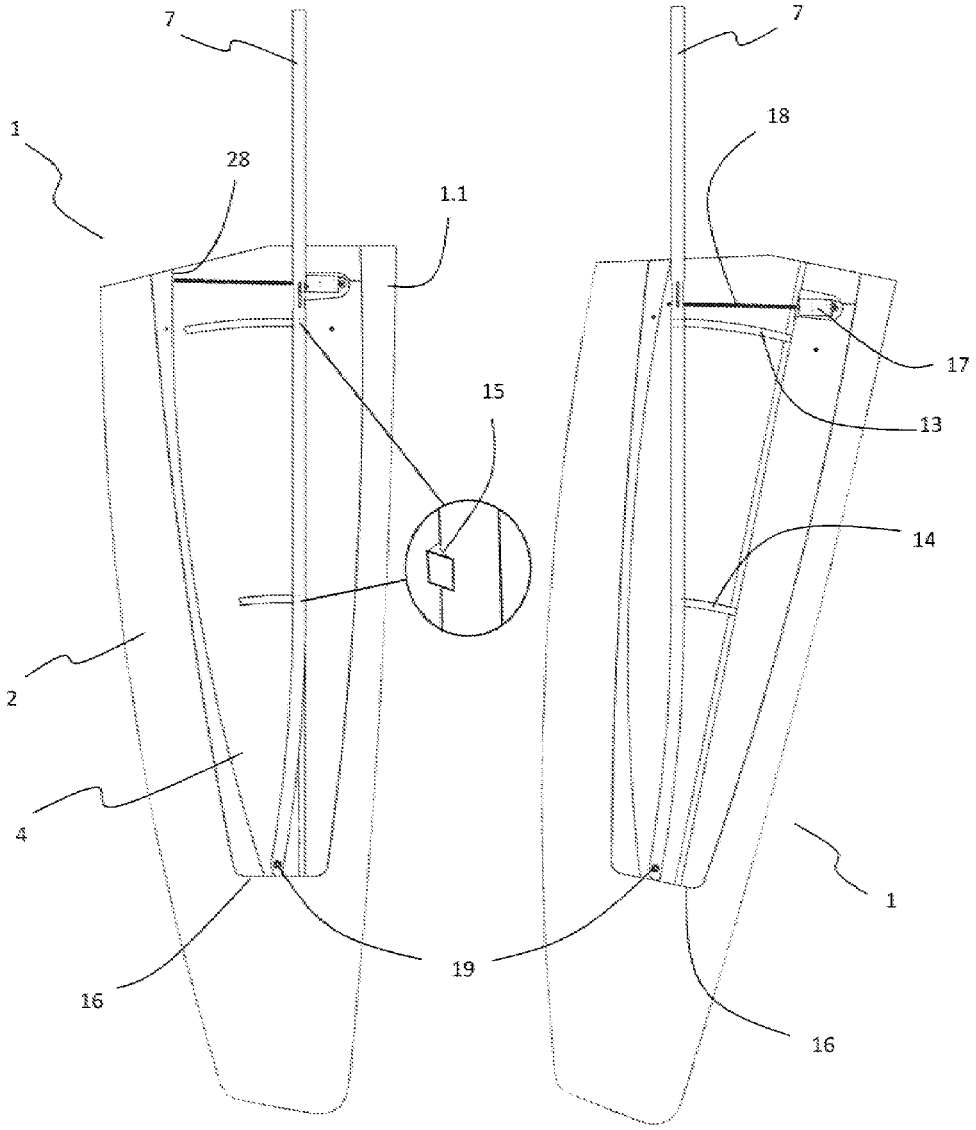
FIG. 2A is a side view showing the view in FIG. 1A wherein the second rudder part is removed.
FIG. 2B is a side view showing the view in FIG. 2A wherein the second rudder part is removed.
Figure 3B:
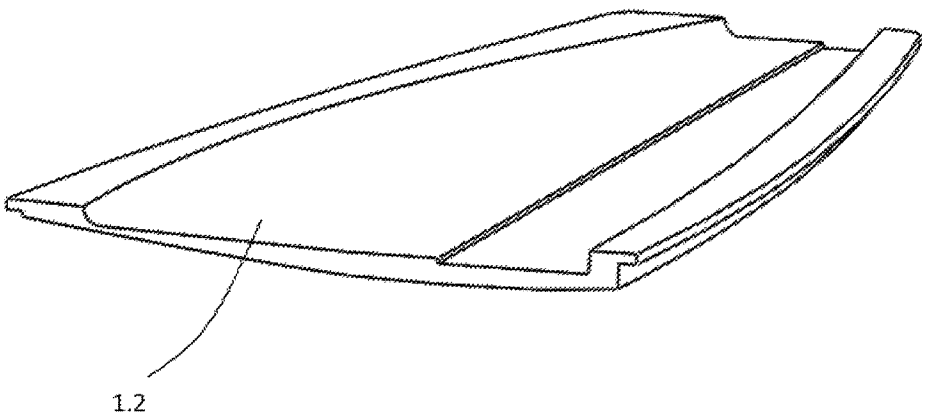
FIG. 3B is a perspective view of the second rudder part.
Figure 3A:
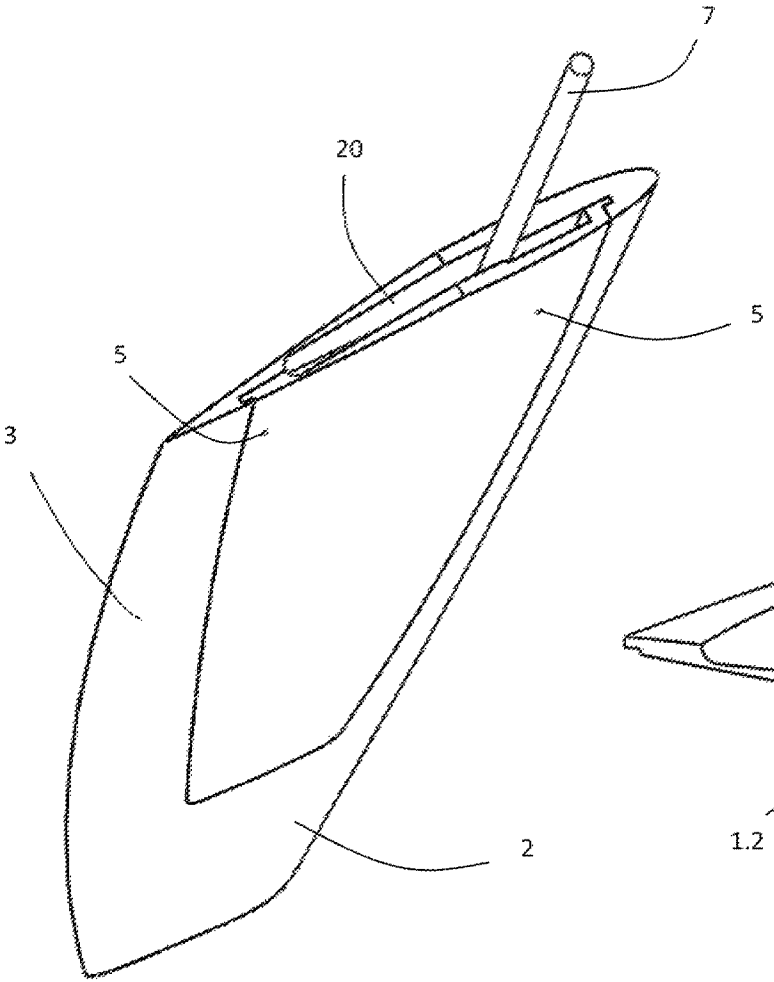
FIG. 3A is an upper perspective view of the rudder mechanism according to the invention.

The first rudder part (1.1) comprises one or more support pieces having arcuate form extending substantially in horizontal direction at the inner surface thereof. According to a preferred embodiment of the invention, the rudder (1) comprises two support pieces being a first support piece (13) and a second support piece (14) spaced apart from the first piece in the vertical direction. As illustrated in FIG. 2A, the vertical rudder shaft (7) comprises radial shaft slots (15) equal to the number of support pieces. The form of the shaft slots (15) is compatible with the form of the support pieces, and when the support pieces are inserted into the shaft slots, the vertical rudder shaft (7) is supported on bearings.

A housing (22) is formed at a spot close to the upper side of the first rudder part (1.1) for receiving a motor (17). At the output of the motor (17), there is provided a threaded motor shaft (18) substantially extending radially to the vertical rudder shaft (7). A slide (26) is placed on the motor shaft (18), which can move linearly upon rotation of this shaft (18). Threads are formed at the inner surface of the slide (26). The threads of the slide are in conformity with those of the motor shaft (18). Such a motor configuration is commercially available from Maxon under the "spindle drive" type motors.

The slide (26) comprises slide pins (25) oppositely extending outwardly from the sides of thereof. The slide pins (25) communicate with the axial slide supporting cavities (24) in such manner to move inside the same formed mutually at the vertical rudder shaft (7). The vertical rudder shaft (7) further comprises axial shaft inlet cavities (23) oppositely formed for insertion of the motor shaft (18) therethrough.

FIG. 1A and FIG. 2A illustrates the position of the rudder (1) in forward movement of a marine vessel comprising the rudder mechanism according to the invention. In forward movement, the rudder (1) area that remains at the front side of the vertical rudder shaft axis (12) is smaller than the area that remains at the rear side of the axis (12) and thus, as the rudder steered as mentioned in U.S. Pat. No. 7,806,068, the forward maneuver of the marine vessel can be easily achieved. In this case, the vertical rudder shaft (7) is leaned to a shaft leaning surface (27) that extends vertically to the interior section of the rudder (1) as illustrated in FIG. 2A and detail of which is provided in FIG. 4A.

Before the marine vessel starts its backwards movement (depending on the user or automatically, when starting to move backwards and even may be after moving backwards) the shaft drive motor (17) is activated and upon rotation of the motor shaft (18), the slide (26) is forced to a linear movement. As the vertical rudder shaft (7) is fixed to the rudder mechanism from the upper end, the rudder (1) rotates around the hinge (19) and gets the position as illustrated in FIG. 1B or 2B. At this position, the vertical rudder shaft (7)

leans to the shaft leaning edge (28) located at the upper part of the rudder slot (4), and likewise, at this position, the rudder (1) area that remains at the rear side of the vertical rudder shaft axis (12) is smaller than the area that remains at the front side of the axis (12) and thus, as the rudder steered as mentioned in U.S. Pat. No. 7,806,068, the backwards maneuver of the marine vessel can be easily achieved.

The motor housing (22) is made sufficiently large in order to avoid jamming of the motor (17) within the motor housing (22) when the rudder (1) rotates around the hinge (19) axis relative to the vertical rudder shaft (7). Likewise, as the slide pins (25) are located at the uppermost side of the slide support cavity (24) during forward movement of the marine vessel, when the rudder (1) is rotated for backwards movement of the marine vessel, the slide pins (25) come to the lowermost part of the slide supporting cavity (24).

The drive mechanism rotating the rudder (1) around the vertical rudder shaft (7) may also be a hydraulic piston as mentioned in U.S. Pat. No. 7,806,068 other than the motor (17), motor shaft (18) and slide (26) combination. U.S. Pat. No. 7,806,068 is incorporated herein by reference.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A rudder mechanism for a marine vessel comprising:

a rudder (1) having an upper side, a lower side, a first water flow surface (2) having substantially planar form and an opposite second water flow surface (3) having substantially planar form;

a vertical rudder shaft (7) rotatably communicating with the rudder (1) about an axis that substantially extending perpendicular to the water flow surfaces of the rudder (1); and a drive mechanism for rotating the rudder (1) around the axis, the rudder mechanism further comprises a rudder slot (4) extending from the upper side of the rudder (1) towards the bottom side thereof for receiving the vertical rudder shaft (7);

wherein the rotatable communication of the rudder (1) and the vertical rudder shaft (7) is provided substantially close to a rudder slot bottom (16) and the drive mechanism is communicated with the vertical rudder shaft (7) to exert force in the radial direction thereto.

2. A rudder mechanism according to claim 1, wherein the rudder slot bottom (16) is at a lower level than the center of the rudder (1) height with respect to the vertical length of the rudder (1).

3. A rudder mechanism according to claim 1, wherein the rudder (1) comprises a first rudder part (1.1) having a shell form, and a second rudder part (1.2) having a shell form and fixed to the first rudder part (1.1).

4. A rudder mechanism according to claim 3, wherein the first rudder part (1.1) is larger than the second rudder part (1.2) and has a different form and that the external surface of the first rudder part (1.1) covers one lateral surface of the rudder (1) completely and covers a certain portion of the other lateral surface of the rudder (1).

5. A rudder mechanism according to claim 4, wherein the first rudder part (1.1) comprises at least one support piece (13, 14) having an arcuate form, at least one support piece (13, 14) extending substantially in horizontal direction at its inner surface.

6. A rudder mechanism according to claim 5, wherein the vertical rudder shaft (7) comprises at least one radial shaft slot (15) supported by at least one support piece (13, 14).

7. A rudder mechanism according to claim 1, wherein the drive mechanism comprises a motor (17), a threaded motor shaft (18) communicating with the motor (17), and a slide (26) on the motor shaft (18), the slide (26) being linearly movable upon rotation of the shaft (18) and being communicated with the rudder shaft (7).

8. A rudder mechanism according to claim 7, wherein the slide (26) comprises oppositely provided slide pins (25) extending outwardly from sides thereof, and the vertical rudder shaft (7) comprises axial slide supporting cavities (24) oppositely formed for receiving the slide pins (25).

9. A rudder mechanism according to claim 8, wherein the vertical rudder shaft (7) comprises oppositely formed axial shaft inlet cavities (23) for insertion of the motor shaft (18) therethrough.

10. A rudder mechanism according to claim 4, further comprises a motor housing (22) formed at a spot close to the upper side of the first rudder part (1.1) for receiving the motor (17).

11. A rudder mechanism according to claim 1, wherein the drive mechanism is a hydraulic piston mechanism.

12. A marine vessel including the rudder mechanism of claim 1.

13. A rudder mechanism for a marine vessel comprising:

a rudder comprising an upper side, a lower side, a first water flow surface having substantially planar form and an opposite second water flow surface having substantially planar form, said rudder further comprising a first lateral surface, a second lateral surface, a first rudder part having a first external surface and a first shell form, and a second rudder part having a second external surface and a second shell form fixed to the first rudder part, wherein the first rudder part is larger than the second rudder part, the first rudder part having a different form than the second rudder part, further wherein the first external surface completely covers the first lateral surface and a portion of the second lateral surface;

a vertical rudder shaft rotatably communicating with the rudder about an axis that extends substantially perpendicular to the water flow surfaces of the rudder; and a drive mechanism for rotating the rudder around the axis, the rudder mechanism further comprises a rudder slot extending from the upper side of the rudder towards the bottom side thereof for receiving the vertical rudder shaft;

wherein the rotatable communication of the rudder and the vertical rudder shaft is provided substantially close to a rudder slot bottom and the drive mechanism is communicated with the vertical rudder shaft to exert force in the radial direction thereto.

14. A rudder mechanism according to claim 13, further comprises a motor housing formed at a spot close to the upper side of the first rudder part for receiving the motor.

15. A rudder mechanism for a marine vessel comprising:

a rudder having an upper side, a lower side, a first water flow surface having substantially planar form and an opposite second water flow surface having substantially planar form;

a vertical rudder shaft rotatably communicating with the rudder about an axis that extends substantially perpendicular to the water flow surfaces of the rudder; and a drive mechanism for rotating the rudder around the axis, the rudder mechanism further comprises a rudder slot extending from the upper side of the rudder towards the bottom side thereof for receiving the vertical rudder shaft, said rudder slot having a shaft leaning surface and a shaft leaning edge;

wherein the rotatable communication of the rudder and the vertical rudder shaft is provided substantially close to a rudder slot bottom and the drive mechanism is communicated with the vertical rudder shaft to exert force on the vertical rudder shaft in a radial direction positioning said vertical rudder shaft proximate to said shaft leaning surface in a first position and positioning said vertical rudder shaft proximate to said shaft leaning edge in a second position.

* * * * *